US006742865B2

(12) United States Patent
Yusef et al.

(10) Patent No.: US 6,742,865 B2
(45) Date of Patent: Jun. 1, 2004

(54) CARRIAGE GUIDE FOR INKJET PRINTER

(75) Inventors: Haseeb Yusef, Vancouver, WA (US); Yong K. Park, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 22 days.

(21) Appl. No.: 10/232,582

(22) Filed: Aug. 29, 2002

(65) Prior Publication Data

US 2003/0076379 A1 Apr. 24, 2003

Related U.S. Application Data

(63) Continuation of application No. 10/002,650, filed on Oct. 19, 2001, now Pat. No. 6,520,622.

(51) Int. Cl.[7] ..... B41J 23/00
(52) U.S. Cl. ..... 347/37
(58) Field of Search ..... 347/7, 8, 37, 63, 347/49; 400/674, 691

(56) References Cited

U.S. PATENT DOCUMENTS 4,755,836 A 7/1988 Ta et al.
4,914,562 A * 4/1990 Abe et al. ..... 347/63
5,250,957 A 10/1993 Onozato
5,368,403 A 11/1994 Broder et al.
5,455,607 A * 10/1995 Rhoads et al. ..... 347/8
5,488,397 A 1/1996 Nguyen et al.
5,924,809 A 7/1999 Wotton et al.
6,270,184 B1 8/2001 Igarashi et al.
6,520,622 B1 * 2/2003 Yusef et al. ..... 347/37

OTHER PUBLICATIONS

"Epson Introduces New $79 Value–PackedColor Ink Jet Printer and New Feature–Rich Color Ink Jet for PC Bundles", Business Editors & High Tech Writers, Business Wire, Sep. 4, 2001, 2 pages.
EPSON Stylus C40UX At–A–Glance, Epson America, Inc., Oct. 2001, 1 page.
EPSON Stylus C40UX/C20UX Start Here, Epson America, Inc., 2001, 2 pages.
EPSON Stylus C40UX/C20UX Reference Guide, How To/Replacing Ink Cartridges, Selko Epson Corp., 2000, 5 pages.
EPSON Stylus C40UX/C20UX Reference Guide, How To/Maintenance, Seiko Epson Corp., 2000, 2 pages.
EPSON Stylus C40UX Product Information Guide, 8 pages.
EPSON Stylus C40UX Images, 6 images, Aug. 2002, 4 sheets.

* cited by examiner

*Primary Examiner*—Anh T. N. Vo

(57) ABSTRACT

A carriage guide for a carriage of an inkjet printer includes a chassis including a first chassis sidewall and a second chassis sidewall spaced from the first chassis sidewall, and a carriage track extending between the first chassis sidewall and the second chassis sidewall. The carriage track forms at least two support surfaces configured to support the carriage for movement along the carriage track.

34 Claims, 7 Drawing Sheets

CARRIAGE GUIDE FOR INKJET PRINTER

CROSS-REFERENCE TO RELATED APPLICATIONS

This is a Continuation of U.S. patent application Ser. No. 10/002,650, filed on Oct. 19, 2001 now U.S. Pat. No. 6,520,622, assigned to the assignee of the present invention and incorporated herein by reference.

THE FIELD OF THE INVENTION

The present invention relates generally to inkjet printers, and more particularly to a carriage guide for a carriage of an inkjet printer.

BACKGROUND OF THE INVENTION

A conventional inkjet printing system includes a printhead assembly, an ink supply which supplies liquid ink to the printhead assembly, and an electronic controller which controls the printhead assembly. The printhead assembly, commonly referred to as a print cartridge or pen, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead assembly and the print medium are moved relative to each other. To position the printhead assembly relative to the print medium, the conventional inkjet printing system includes a carriage assembly. As such, the printhead assembly is positioned in, and supported by, the carriage assembly. As illustrated in FIG. 1, a conventional carriage assembly 200 typically includes a carriage 202 and a carriage guide 204. As such, the carriage supports a print cartridge 206, including a printhead assembly 207, for movement relative to a print medium 208. Typically, the carriage guide includes a carriage rod 210 supported by sidewalls and mounted horizontally to guide and retain the carriage. To stabilize the carriage and prevent rotation of the carriage about the carriage rod, the carriage assembly typically includes an anti-rotation rail 212 supported by a hanger 214. In addition, adjustment of the anti-rotation rail on the hanger varies the spacing between the printhead assembly and the print medium. Thus, to establish the desired spacing between the printhead assembly and the print medium, the anti-rotation rail is adjusted and secured in position during assembly. Other designs have used two spaced carriage rods to guide and stabilize the carriage.

Typically, the carriage rod is a precision ground steel rod. As such, the precision ground steel rod allows the carriage to move with minimal impediment with frequent changes in direction along the carriage guide. Thus, in order to maintain a precise and consistent spacing between the printhead assembly and the print medium, the precision ground steel rod is fabricated to very close tolerances. In addition, the precision ground steel rod requires assembly which, understandably, is labor intensive. Thus, the cost required to fabricate and assemble the precision ground steel rod results in a more expensive manufacturing process.

Accordingly, a need exists for a carriage guide of reduced cost which supports a carriage of an inkjet printer for movement with minimal impediment with frequent changes in direction along the carriage guide.

SUMMARY OF THE INVENTION

One aspect of the present invention provides a carriage guide for a carriage of an inkjet printer. The carriage guide includes a chassis including a first chassis sidewall and a second chassis sidewall spaced from the first chassis sidewall, and a carriage track extending between the first chassis sidewall and the second chassis sidewall. The carriage track forms at least two support surfaces configured to support the carriage for movement along the carriage track.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "downward," "upward," "upper," "lower," etc., is used with reference to the orientation of the figures being described. The inkjet printing system and related components of the present invention can be positioned in a number of different orientations. As such, the directional terminology is used for purposes of illustration and is no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
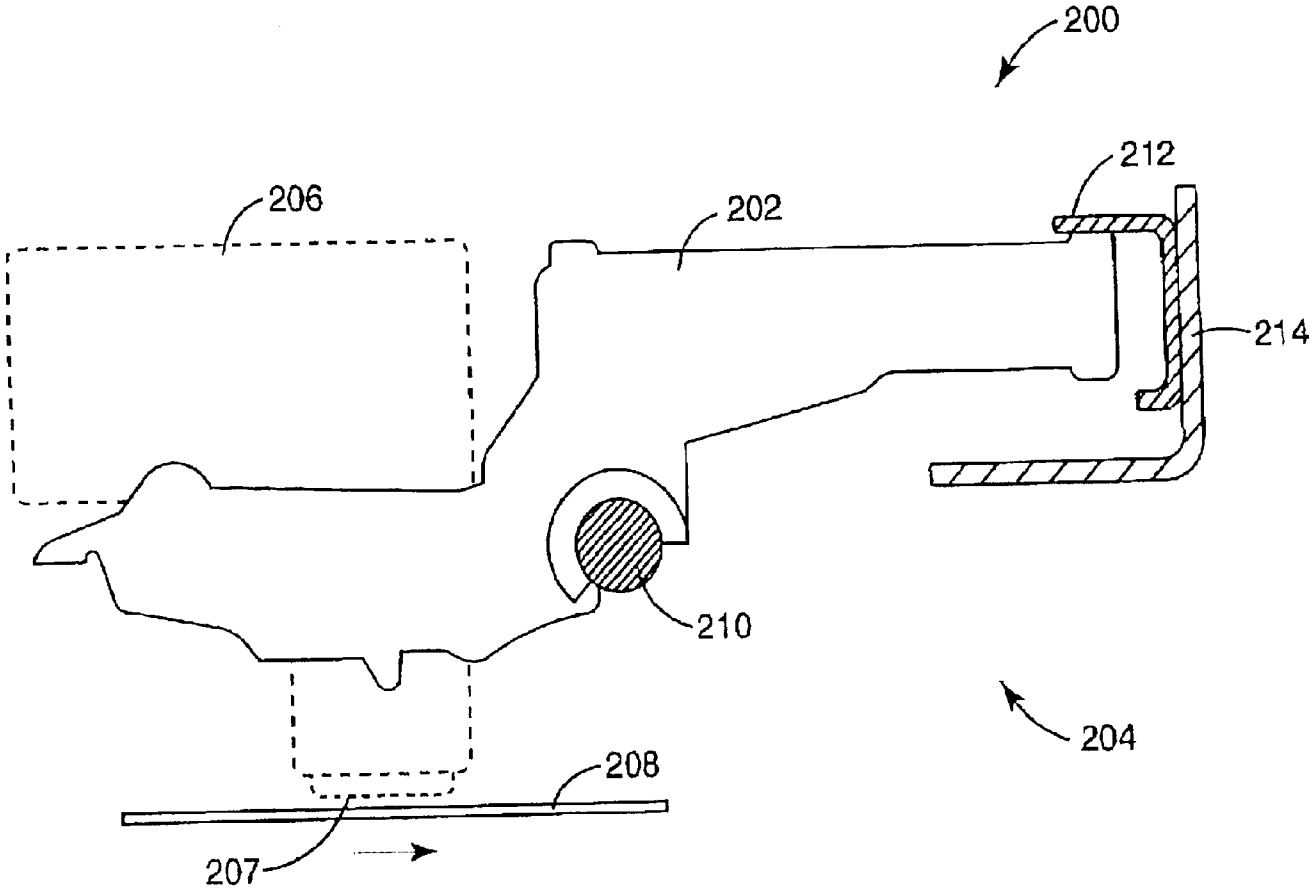
Fig. 1 PRIOR ART
FIG. 1 is a schematic, cross-sectional view of a prior art carriage assembly.
Figure 2:
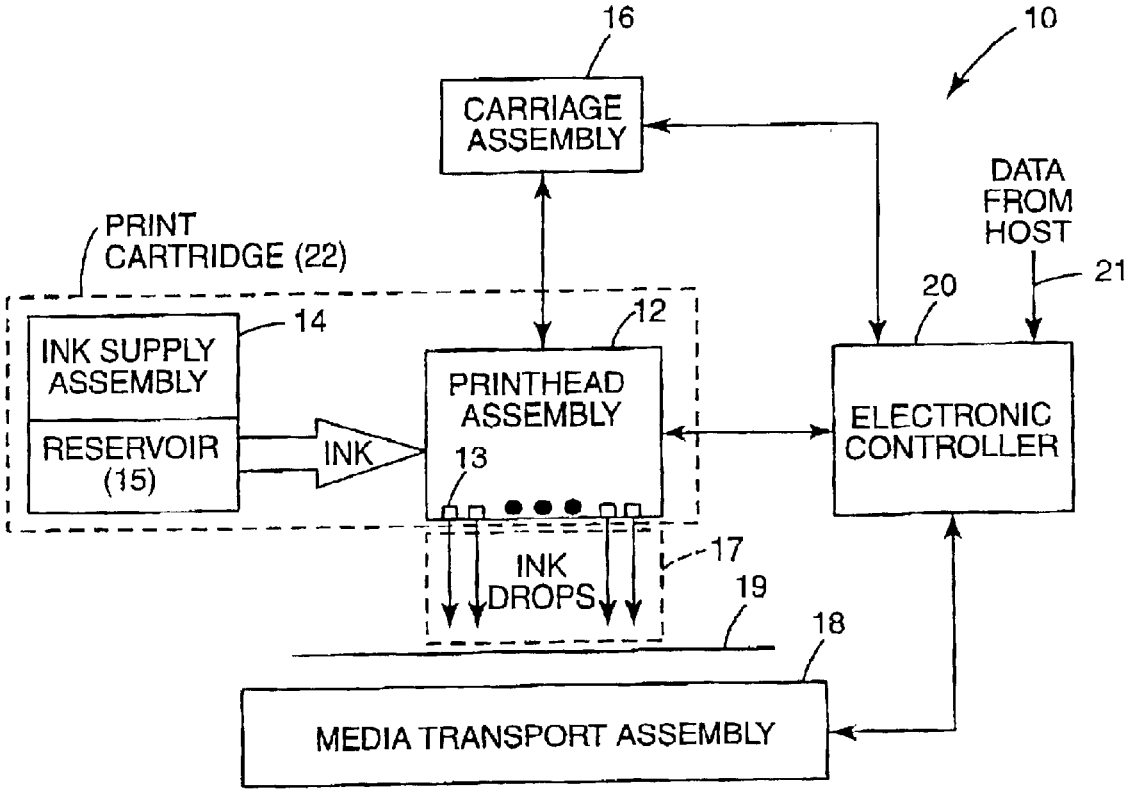
FIG. 2 is a block diagram illustrating one embodiment of an inkjet printing system according to the present invention.

FIG. 2 illustrates one embodiment of a portion of an inkjet printing system according to the present invention. Inkjet printing system 10 includes an inkjet printhead assembly 12, an ink supply assembly 14, a carriage assembly 16, a media transport assembly 18, and an electronic controller 20. Inkjet printhead assembly 12 includes a printhead which ejects drops of ink through a plurality of orifices or nozzles 13 and toward a print medium 19 so as to print onto print medium 19. Print medium 19 is any type of suitable sheet material, such as paper, cardstock, transparencies, Mylar, and the like. Typically, nozzles 13 are arranged in one more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12.

In one embodiment, inkjet printhead assembly 12 and ink supply assembly 14 are housed together in an inkjet print cartridge or pen, as defined by dashed line 22. In another embodiment, ink supply assembly 14 is separate from inkjet printhead assembly 12 and supplies ink to inkjet printhead assembly 12. In either embodiment, reservoir 15 of ink supply assembly 14 may be removed, replaced, and/or refilled.

Carriage assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In a scanning-type printing system, carriage assembly 16 moves inkjet printhead assembly 12 relative to media transport assembly 18 to scan print medium 19.

Electronic controller 20 communicates with inkjet printhead assembly 12, carriage assembly 16, and media transport assembly 18. Electronic controller 20 receives data 21 from a host system, such as a computer, and includes memory for temporarily storing data 21. Data 21 represents, for example, a document and/or file to be printed. As such, data 21 forms a print job for inkjet printing system 10 and includes one or more print job commands and/or command parameters.

Electronic controller 20 provides control of inkjet printhead assembly 12 including the timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops are determined by the print job commands and/or command parameters.

Figure 3:
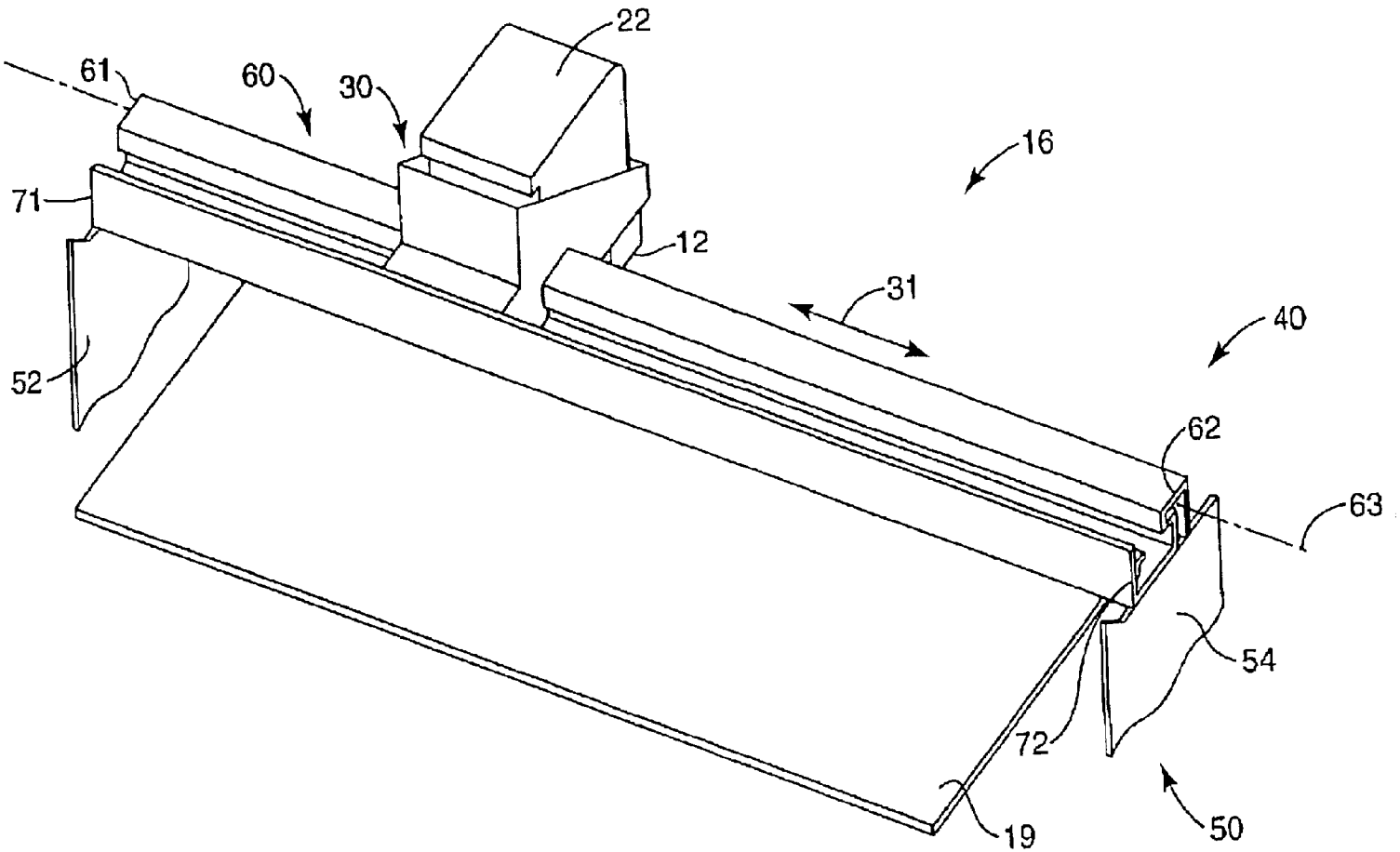
FIG. 3 is a perspective view of one embodiment of a carriage assembly according to the present invention.

FIG. 3 illustrates one embodiment of a portion of carriage assembly 16. Carriage assembly 16 includes a carriage 30 and a carriage guide 40. Carriage 30 carries print cartridge 22, including inkjet printhead assembly 12, and is slidably mounted upon carriage guide 40 to allow lateral movement of carriage 30 in the directions indicated by bi-directional allow 31. Thus, movement of carriage 30 is transverse to the direction in which print medium 19 is advanced during printing.

Carriage guide 40 includes a chassis 50 mounted within a housing (not shown) of inkjet printing system 10 and a carriage track or rail 60. Chassis 50 includes a first chassis sidewall 52 and a second chassis sidewall 54. In one embodiment, first chassis sidewall 52 is spaced from and positioned substantially parallel to second chassis sidewall 54. Preferably, chassis sidewalls 52 and 54 are constructed from metal, such as aluminum or steel, although other relatively rigid materials, such as plastic, are equally acceptable.

Carriage track 60 extends horizontally between first chassis sidewall 52 and second chassis sidewall 54. In one embodiment, a first end 61 of carriage track 60 is attached to first chassis sidewall 52 and a second end 62 of carriage track 60 is attached to second chassis sidewall 54. In this manner, carriage track 60 is oriented substantially perpendicular to both first and second chassis sidewalls 52 and 54. Chassis sidewalls 52 and 54 may have fingered supports and/or shelves or tabs extending horizontally and/or vertically to facilitate attachment of carriage track 60 to chassis sidewalls 52 and 54. Carriage track 60 may be secured to chassis sidewalls 52 and 54 with, for example, screws or anchors, although other attachment methods are within the scope of the present invention.

Figure 4:
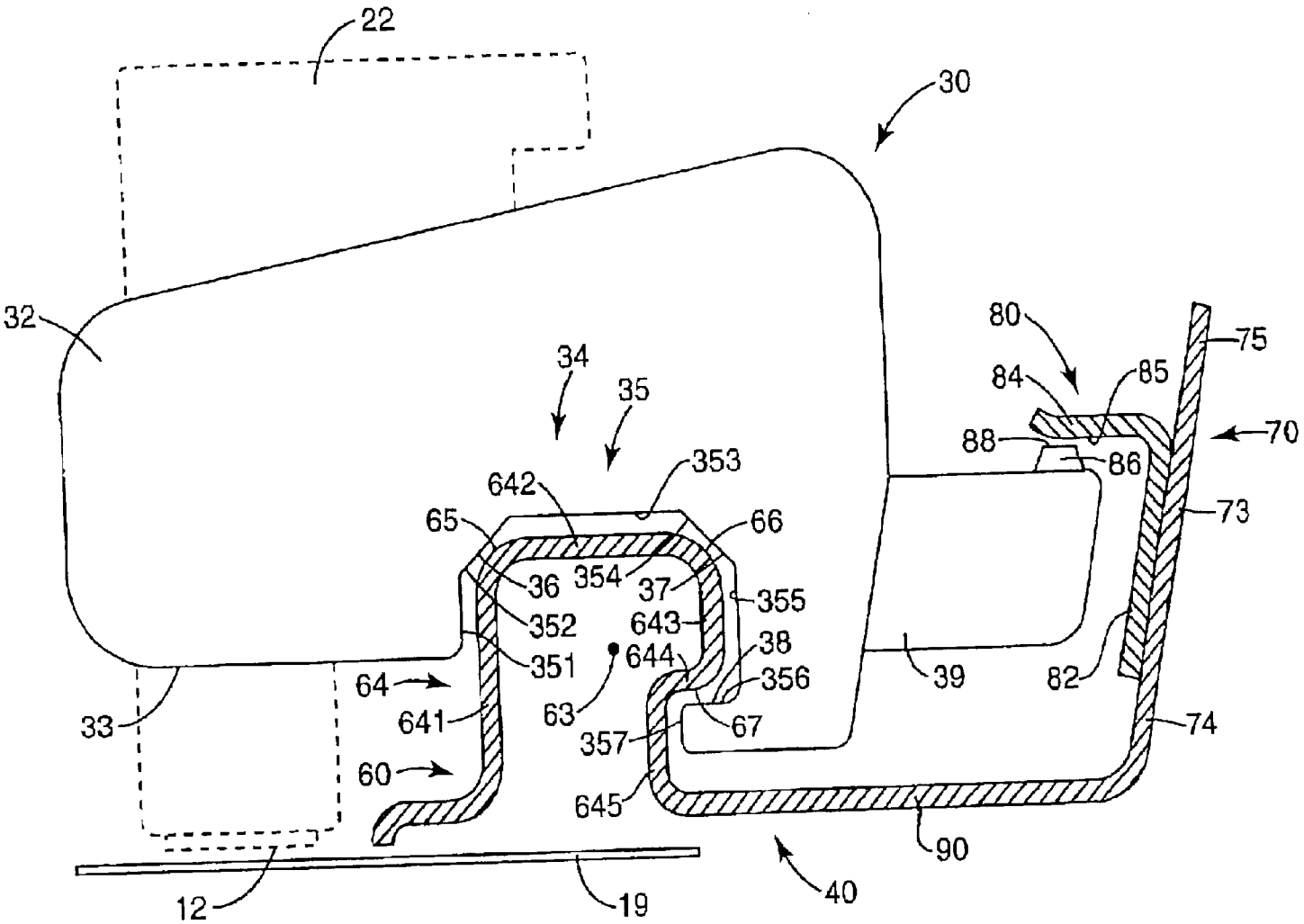
FIG. 4 is a schematic, cross-sectional view of the carriage assembly of FIG. 3 illustrating one embodiment of a carriage guide and a carriage according to the present invention.

As illustrated in FIGS. 3 and 4, carriage track 60 serves as a support member for carriage 30 and has an axis 63 that extends along a length of carriage track 60, substantially perpendicular to first chassis sidewall 52 and second chassis sidewall 54. As such, carriage track 60 is formed to receive carriage 30 and to allow carriage 30 to move laterally back and forth across carriage track 60 along axis 63. In one embodiment, first chassis sidewall 52 and second chassis sidewall 54 are positioned below carriage track 60 and carriage track 60 extends between and beyond first chassis sidewall 52 and second chassis sidewall 54. As such, carriage track 60 accommodates over-travel or, more specifically, movement of carriage 30 along carriage track 60 between and beyond first chassis sidewall 52 and second chassis sidewall 54. Thus, printing can occur between first chassis sidewall 52 and second chassis sidewall 54.

In one embodiment, carriage track 60 is formed of a plurality of fully integrated legs or segments 64. Each carriage track segment 64 is positioned to run from a first edge to a second edge, in a direction extending substantially parallel with axis 63. In addition, each carriage track segment 64 forms a substantially planar surface oriented substantially parallel with axis 63. Preferably, carriage track 60 is formed, bent, or extruded from metal, such as aluminum or steel, although other relatively rigid materials, such as plastic, are equally acceptable.

In one embodiment, carriage track 60 includes carriage track segments 641, 642, 643, 644, and 645. Carriage track segments 641, 642, 643, 644, and 645 are arranged or associated with one another to form carriage track 60 with a substantially P-shaped cross-section. As such, carriage track segment 641 has a substantially vertical orientation, such that a second edge of carriage track segment 641 is located above a first edge of carriage track segment 641. The second edge of carriage track segment 641 is connected to a first edge of carriage track segment 642 in a manner that orientates carriage track segment 642 in a substantially horizontal position, substantially perpendicular to carriage track segment 641. A second edge of carriage track segment 642 is connected to a first edge of carriage track segment 643 such that carriage track segment 643 extends downward from and substantially perpendicular to carriage track segment 642. A second edge of carriage track segment 643 is connected to a first edge of carriage track segment 644. Carriage track segment 644 extends in a substantially horizontal manner from the second edge of carriage track segment 643 towards carriage track segment 641. A second edge of carriage track segment 644 is attached to a first edge of fifth carriage track segment 645, and carriage track segment 645 extends in a downward and substantially perpendicular manner from carriage track segment 644. Additional segments or legs may be added to the first edge of carriage track segment 641 and/or the second edge of carriage track segment 645 to facilitate attachment of carriage track 60 to first and second chassis sidewalls 52 and 54, to increase the overall stability of carriage track 60, and/or to act as a locating feature for carriage track 60.

The resulting P-shaped cross-section of carriage track 60 supports and stabilizes carriage 30 as it traverses print medium 19. As such, carriage track 60 forms a first support surface 65 at a junction of carriage track segments 641 and 642, a second support surface 66 at a junction of carriage track segments 642 and 643, and a third support surface 67 on carriage track segment 644. In one embodiment, first, second, and third support surfaces 65, 66, and 67 of carriage track 60 contact and, as a result, provide support to carriage 30.

Carriage 30 includes a carriage shell 32 and a carriage base 33 which supports carriage shell 32. Carriage base 33 includes a channel or receptor groove 34 sized and shaped to interact with first, second, and third support surfaces 65, 66, and 67 of carriage track 60. Receptor groove 34 has a plurality of integrated sidewalls 35 sized and shaped to correspond with the configuration of carriage track 60. For example, receptor groove 34 is sized and shaped to correspond with the substantially P-shaped cross-section of carriage track 60. In one embodiment, receptor groove 34 has sidewalls 351, 352, 353, 354, 355, 356, and 357. As such, sidewall 351 has a substantially vertical orientation. An edge of sidewall 351 is contiguous with sidewall 352 such that sidewall 352 extends at an upward angle from sidewall 351. An edge of sidewall 352 is contiguous with a first edge of sidewall 353 such that sidewall 353 extends in a substantially horizontal manner from sidewall 352. Sidewall 354 is contiguous with a second edge of sidewall 353 such that sidewall 354 extends in a downward angle from sidewall 353. Sidewall 355 is contiguous with and extends in a substantially vertical direction from an edge of sidewall 354. A first edge of sidewall 356 is contiguous with an edge of sidewall 355, and sidewall 356 extends towards sidewall 351 with a substantially horizontal orientation. A second edge of sidewall 356 is contiguous with an edge of sidewall 357, and sidewall 357 extends from sidewall 356 in a downward and substantially vertical manner.

Receptor groove 34 forms a number of contact surfaces that interact with carriage track 60. In one embodiment, sidewall 352, sidewall 354, and sidewall 356 form a first contact surface 36, a second contact surface 37, and a third contact surface 38, respectively. First, second, and third contact surfaces 36, 37, and 38 interact with carriage track 60 at first, second, and third support surfaces 65, 66, and 67. More specifically, first and second contact surfaces 36 and 37 interact with first and second support surfaces 65 and 66, respectively, to guide carriage 30 on carriage track 60 and third contact surface 38 interacts with third support surface 67 to retain carriage 30 on carriage track 60 and prevent lift-off of carriage 30. The interaction between contact surfaces 36, 37, and 38 and support surfaces 65, 66, and 67 allows carriage 30 to traverse carriage track 60. Contact surfaces 36, 37, and 38 and/or support surfaces 65, 66, and 67 may be lubricated, wear protected, and/or kept clear of dust and debris, in manners known in the art, to ensure the smooth movement of carriage 30 across carriage track 60. For clarity of the invention, contact surfaces of carriage 30 are illustrated as being spaced from respective support surfaces of carriage track 60. It is, however, understood that contact surfaces of carriage 30 contact respective support surfaces of carriage track 60 to support carriage 30 for movement along carriage track 60.

In one embodiment, carriage guide 40 further includes a hanger 70. Hanger 70 is spaced from and oriented substantially parallel with carriage track 60. Hanger 70 has a first end 71 and a second end 72 attached to first chassis sidewall 52 and second chassis sidewall 54, respectively, of chassis 50 (FIG. 3). Hanger 70 includes a primary segment 73 that has an upright orientation. Primary segment 73 has a first edge 74 and a second edge 75 and is oriented such that first edge 74 is positioned below second edge 75. Hanger 70 is used, for example, to support a number of inkjet printer components, such as an anti-rotation rail, as described below, a carriage motor and/or print media transport components, as well as to facilitate attachment of a printer cover and/or a cable harness.

In one embodiment, hanger 70 supports an anti-rotation rail 80. Anti-rotation rail 80 includes a connection segment 82 and a stabilization segment 84. Connection segment 82 is connected to primary segment 73 of hanger 70. In this respect, an orientation of connection segment 82 is determined by an orientation of primary segment 73 to ensure a secure connection. In one embodiment, stabilization segment 84 extends from connection segment 82 in a substantially horizontal manner toward carriage track 60. Stabilization segment 84 includes a support surface 85 which interacts with carriage 30 to stabilize carriage 30 and prevent rotation of carriage 30 about carriage track 60. Preferably, anti-rotation rail 80 is formed from metal, such as aluminum or steel, however, other relatively rigid materials, such as plastic, are equally acceptable. Anti-rotation rail 80 may also be connected to chassis sidewalls 52 and 54 for additional support.

In one embodiment, carriage 30 includes a wear device 86 at a point of contact with support surface 85 to more effectively maintain proper contact with support surface 85 and to prevent hindrance of carriage 30 as it moves across carriage track 60. Wear device 86 is provided, for example, on a carriage arm 39 extending from carriage shell 32. Wear device 86 provides a contact or anti-rotation surface 88 that slidably interacts with support surface 85. As such, anti-rotation surface 88 and/or support surface 85 may be lubricated, wear protected, and/or kept clear of dust and debris, in manners known in the art, to ensure smooth movement of wear device 86 along anti-rotation surface 88. In one embodiment, wear device 86 is located below anti-rotation rail 80. It is, however, within the scope of the present invention for wear device 86 and anti-rotation rail 80 to interact with other configurations.

In one embodiment, a bridge 90 extends between carriage track 60 and hanger 70. More specifically, bridge 90 extends from the second edge of carriage track segment 645 of carriage track 60 to first edge 74 of primary segment 73 of hanger 70. Preferably, carriage track 60, bridge 90, and hanger 70 are integrally formed as one unitary structure to form a monolithic stay. Forming of carriage track 60, bridge 90, and hanger 70 as a monolithic stay allows installation of all three components in one simplified step. While illustrated as being one integral piece, it is, however, within the scope of the present invention for carriage track 60, bridge 90, and hanger 70 to be formed separately and joined together to form a unified structure. In addition, by providing anti-rotation rail 80 on hanger 70, carriage track 60 and anti-rotation rail 80 for carriage 30 can be installed in one step.

Figure 5:
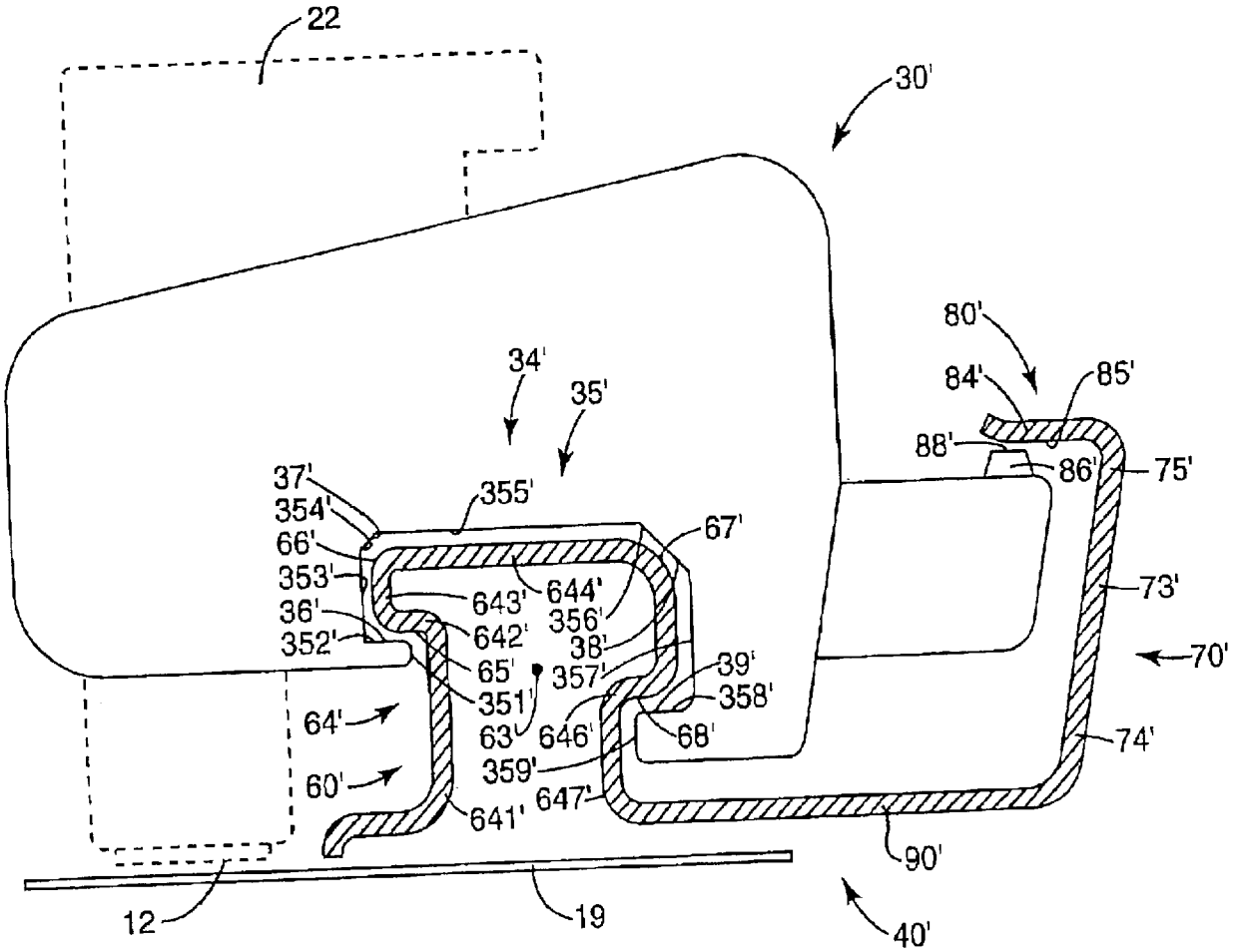
FIG. 5 is a schematic, cross-sectional view similar to FIG. 4 illustrating another embodiment of a carriage guide and a carriage according to the present invention.

FIG. 5 illustrates another embodiment of carriage guide 40. Carriage guide 40', similar to carriage guide 40, includes a carriage track 60' for supporting a carriage 30'. However, carriage track 60' has a substantially T-shaped cross-section. As such, carriage track 60' has an axis 63' and includes a plurality of fully integrated legs or segments 64', which extend substantially parallel with axis 63'. Similar to carriage track segments 64, each carriage track segment 64' forms a substantially planar surface oriented substantially parallel with axis 63'.

In one embodiment, carriage track 60' includes carriage track segments 641', 642', 643', 644', 645', 646', and 647'. Carriage track segments 641', 642', 643', 644', 645', 646', and 647' are arranged or associated with one another to form carriage track 60' with the substantially T-shaped cross-section. As such carriage track segment 641' has a substantially vertical orientation. An edge of carriage track segment 641' is connected to a first edge of carriage track segment 642', such that carriage track segment 642' extends from and substantially perpendicular to carriage track segment 641'. In other words, carriage track segment 642' extends in a substantially horizontal position. A second edge of carriage track segment 642' is connected to a first edge of carriage track segment 643', such that carriage track segment 643' extends upward from and substantially perpendicular to carriage track segment 642'. A second edge of carriage tract segment 643" is connected to a first edge of carriage track segment 644'. Carriage track segment 644' extends in a substantially horizontal manner from the second edge of carriage track segment 643', such that carriage track segment 644' extends substantially parallel with carriage track segment 642'. A second edge of carriage track segment 644' is connected to a first edge of carriage track segment 645', such that carriage track segment 645' extends in a downward and substantially perpendicular manner from carriage track segment 644'. A second edge of carriage track segment 645' is connected to a first edge of carriage track segment 646', such that carriage track segment 646' extends from and substantially perpendicular to carriage track segment 645' towards carriage track segment 641'. A second edge of carriage track segment 646' connects to a first edge of carriage track segment 647'. Carriage track segment 647' extends downward from and substantially perpendicular to carriage track segment 646'. Additional segments or legs may be added to a first edge of carriage track segment 641' and/or a second edge of carriage track segment 647' to further increase a stability of carriage track 60' and/or facilitate attachment of carriage track 60' to first and second chassis sidewalls 52 and 54 (FIG. 3).

The substantially T-shaped configuration of carriage track 60' supports and stabilizes carriage 30' as it traverses print medium 19. As such, carriage track 60' forms a first support surface 65' on carriage track segment 642', a second support surface 66' at a junction of carriage track segments 643' and 644', a third support surface 67' at a junction of carriage track segments 644' and 645', and a support surface on carriage track segment 646'. In one embodiment, first, second, third, and fourth support surfaces 65', 66', 67', and 68' of carriage track 60' contact and support carriage 30'.

Carriage 30' carries print cartridge 22, including inkjet printhead assembly 12, and is slidably mounted upon carriage guide 40'. As such, carriage 30' includes a receptor groove 34' sized and shaped to interact with carriage track 60'. Receptor groove 34' corresponds with the substantially T-shaped cross-section of carriage track 60' and includes a plurality of integrated sidewalls 35'. In one embodiment, receptor groove 34' has sidewalls 351', 352', 353', 354', 355', 356', 357', 358', and 359'. Sidewall 351' has a substantially vertical orientation and includes an edge contiguous with an edge of sidewall 352'. Sidewall 352' extends from sidewall 351' with a substantially horizontal orientation, and an edge of sidewall 352' is contiguous with an edge of sidewall 353'. Sidewall 353' has a substantially vertical orientation and an edge contiguous with sidewall 354'. Sidewall 354' extends from sidewall 353' with an upward and angled orientation. An edge of sidewall 354' is contiguous with sidewall 355' such that sidewall 355' extends in a substantially horizontal direction. Sidewall 355' includes an edge that is contiguous with an edge of sidewall 356', and sidewall 356' extends from sidewall 355' with a downward and angled orientation. An edge of sidewall 356' is contiguous with an edge of sidewall 357' such that sidewall 357' extends in a downward and substantially vertical direction from sidewall 356'. An edge of sidewall 356' is contiguous with an edge of sidewall 358'. Sidewall 358' extends from and substantially perpendicular to sidewall 357' toward sidewall 351'. An edge of sidewall 358' is contiguous with sidewall 359' such that sidewall 359' extends with a downward and substantially vertical orientation from sidewall 358'.

Receptor groove 34' forms a number of contact surfaces that interact with carriage track 60'. In one embodiment, sidewall 352' forms a first contact surface 36', sidewall 354' forms a second contact surface 37', sidewall 356' forms a third contact surface 38', and sidewall 358' forms a fourth contact surface 39'. First, second, third, and fourth contact surfaces 36', 37', 38', and 39' interact with first, second, third, and fourth support surfaces 65', 66', 67', and 68', respectively. More specifically, second and third contact surfaces 37' and 38' interact with second and third support surfaces 66' and 67', respectively, to guide carriage 30' on carriage track 60' and first and fourth contact surfaces 36' and 39' interact with first and fourth support surfaces 65' and 68', respectively, to retain carriage 30' on carriage track 60' and prevent lift-off of carriage 30'. Contact surfaces 36', 37', 38', and 39' and/or support surfaces 65', 66', 67', and 68' may be lubricated, wear protected, and/or kept clear of dust and debris to ensure smooth movement of carriage 30' along carriage track 60'.

FIG. 5 illustrates another embodiment of hanger 70 and anti-rotation rail 80. Hanger 70' and anti-rotation rail 80', similar to hanger 70 and anti-rotation rail 80, provide support to other inkjet printer components and interact with a wear shoe 86' of carriage 30' to prevent carriage 30' from rotating about carriage track 60', respectively. Hanger 70' and anti-rotation rail 80', however, are integrally formed as one unitary structure. As such, a stabilization segment 84' of anti-rotation rail 80' extends in a substantially horizontal fashion from a second edge 75' of primary segment 73' of hanger 70' rather than from connection segment 82 of anti-rotation rail 80, as previously described. Similar to stabilization segment 84 and wear device 86, stabilization segment 84' includes a support surface 85' and wear device 86' provides a contact or anti-rotation surface 88'. Thus, support surface 85' interacts with anti-rotation surface 88' to stabilize carriage 30' and prevent rotation of carriage 30' about carriage track 60'. By integrally forming hanger 70' and anti-rotation rail 80', the need to adjust anti-rotation rail 80' relative to hanger 70' to establish the necessary spacing between printhead assembly 12 and print medium 19 is eliminated.

A bridge 90', similar to bridge 90, extends between carriage track 60' and integral hanger 70' and anti-rotation rail 80'. In particular, bridge 90' extends between the second edge of carriage track segment 643' of carriage track 60' and a first edge 74' of hanger 70'. Preferably, carriage track 60', bridge 90', and integral hanger 70' and anti-rotation rail 80' are integrally formed as one unitary structure to form a monolithic stay. Although carriage track 60', bridge 90', and integral hanger 70' and anti-rotation rail 80' are illustrated as a monolithic stay, it is, however, within the scope of the present invention for carriage track 60', bridge 90', and integral hanger 70' and anti-rotation rail 80' to be formed separately and joined together to form a unified structure.

Although integral hanger 70' and anti-rotation rail 80' is illustrated with substantially T-shaped carriage track 60', it is understood that integral hanger 70' and anti-rotation rail 80' may be used in combination with substantially P-shaped carriage track 60 or otherwise configured carriage tracks falling within the scope of the present invention Likewise, hanger 70 and anti-rotation rail 80 may be used in combination with substantially T-shaped carriage track 60' or otherwise configured carriage tracks falling within the scope of the present invention.

Figure 6:
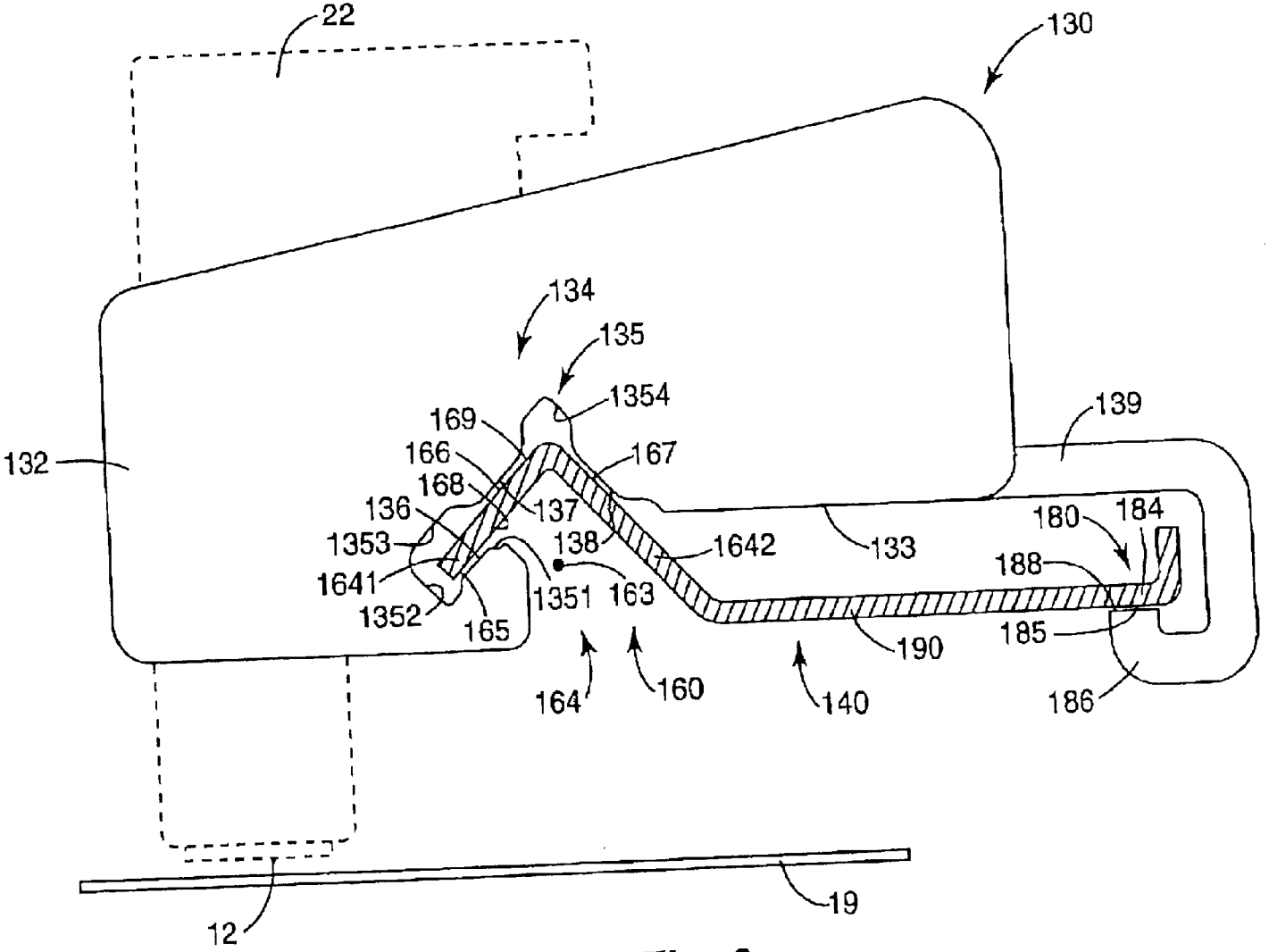
FIG. 6 is a schematic, cross-sectional view of a portion of another embodiment of a carriage guide and a carriage according to the present invention.

FIG. 6 illustrates another embodiment of carriage guide 40. Carriage guide 140 includes a carriage track 160 for supporting a carriage 130. Carriage track 160 has an inverted, substantially V-shaped cross-section. As such, carriage track 160 has an axis 163 and includes a plurality of integrated segments 164 which extend substantially parallel with axis 163. In addition, each carriage track segment 164 forms a substantially planar surface oriented substantially parallel with axis 163.

In one embodiment, carriage track 160 includes carriage track segments 1641 and 1642. Carriage track segments 1641 and 1642 are arranged or associated with one another to form carriage track 160 with the inverted, substantially V-shaped cross-section. Carriage track segment 1641 has an angular orientation with a first edge of carriage track segment 1641 being positioned below a second edge of carriage track segment 1641, such that carriage track segment 1641 extends in an upward angle. Carriage track segment 1642 extends from the second edge of carriage track segment 1641 with a downward and angular orientation relative carriage track segment 1641.

Carriage track segment 1641 of carriage track 160 has a first side 168 and a second side 169 opposite first side 168. As such, first side 168 of carriage track segment 1641 forms a first support surface 165 and second side 169 of carriage track segment 1641 forms a second support surface 166. In addition, carriage track segment 1642 forms a third support surface 167 In one embodiment, first, second, and third support surfaces 165, 166, and 167 of carriage track 160 contact and support carriage 130.

Carriage 130 includes a carriage shell 132 and a carriage base 133. Carriage 130 carries print cartridge 22, including inkjet printhead assembly 12, and is slidably mounted upon carriage track 160. As such, carriage 130 includes a receptor groove 134 sized and shaped to interact with carriage track 160. Receptor groove 134 corresponds with the inverted, substantially V-shaped cross-section of carriage track 160 and includes a plurality of integrated sidewalls 135. In one embodiment, receptor grove 134 has sidewalls 1351, 1352, 1353, and 1354. Sidewall 1351 has an angled orientation and an upper edge and a lower edge. The lower edge of sidewall 1351 is contiguous with sidewall 1352, such that sidewall 1352 extends upward from and substantially perpendicular to sidewall 1351 An edge of sidewall 1352 is contiguous with sidewall 1353. Sidewall 1353 extends upward from and substantially perpendicular to sidewall 1352. Sidewall 1354 is contiguous with and extends downward from and substantially perpendicular to sidewall 1353.

Receptor groove 134 forms a number of contact surfaces that interact with carriage track 160. In one embodiment, sidewall 1351 of receptor groove 134 forms a first contact surface 136, sidewall 1353 forms a second contact surface 137, and sidewall 1354 forms a third contact surface 138. Contact surfaces 136, 137, and 138 interact with first, second, and third support surfaces 165, 166, and 167 of carriage track 160. More specifically, second and third contact surfaces 137 and 138 interact with second and third support surfaces 166 and 167, respectively, to guide carriage 130 on carriage track 160 and first contact surface 136 interacts with first support surface 165 to retain carriage 130 on carriage track 160 and prevent lift-off of carriage 130. The interaction between support surfaces 165, 166, and 167 and contact surfaces 136, 137, and 138 allows carriage 130 to traverse carriage track 160. Contact surfaces 136, 137, 138 and/or support surfaces 165, 166, and 167 may be lubricated, wear protected, and/or kept clear of dust and debris to ensure a smooth interaction between carriage 130 and carriage track 160.

In one embodiment, contact surfaces 136, 137, and/or 138 are each formed by a protrusion from a respective sidewall of receptor groove 134. As such, contact surfaces 136, 137, and/or 138 may each include one continuous surface or a plurality of spaced surfaces extending along a respective sidewall of receptor groove 134. Thus, contact surfaces 136, 137, and 138 each form a contact patch, the area of which is a function, for example, of a mass of carriage 130, on carriage track 160. Likewise, contact surfaces 36, 37, and/or 38 of receptor groove 34 and/or contact surfaces 36', 37', 38', and/or 39' of receptor groove 34' may also be formed by one or more protrusions from respective sidewalls of receptor grooves 34 and 34'.

FIG. 6 illustrates another embodiment of anti-rotation rail 80. Anti-rotation rail 180 is spaced from carriage track 160 and extends between first chassis sidewall 52 and second chassis sidewall 54. Anti-rotation rail 180 includes a stabilization segment 184 having a support surface 185 that interacts with carriage 130 to stabilize carriage 130 and prevent rotation of carriage 130 about carriage track 160.

In one embodiment, carriage 130 includes a wear device 186 including a contact or anti-rotation surface 188 that contacts support surface 185 of anti-rotation rail 180 and maintains proper interaction between anti-rotation rail 180 and carriage 130. Wear device 186 is provided, for example, on a carriage arm 139 extending from carriage shell 132 along carriage base 133. Anti-rotation surface 188 and/or support surface 185 may be lubricated, wear protected, and/or kept clear of dust and debris to ensure smooth interaction and movement of carriage 130 across carriage track 160. In addition, anti-rotation surface 188 of wear device 186 may be formed by a protrusion in a manner similar to that described above with reference to contact surfaces 136, 137, and 138 of receptor groove 134. Likewise, anti-rotation surfaces 88 and/or 88' of wear devices 86 and 86', respectively, may also be formed by a protrusion.

In one embodiment, a bridge 190 extends between carriage track 160 and anti-rotation rail 180. More specifically, bridge 190 extends between an edge of carriage track segment 1642 of carriage track 160 and anti-rotation rail 180. Preferably, carriage track 160, bridge 190, and anti-rotation rail 180 are integrally formed as one unitary structure to form a monolithic stay. Although carriage track 160, bridge 190, and anti-rotation rail 180 are illustrated as a monolithic stay, carriage track 160, bridge 190, and anti-rotation rail 180 may be formed separately and joined together to form a unified structure.

While bridge 190 and anti-rotation rail 180 are illustrated with inverted, substantially V-shaped carriage track 160, it is understood that bridge 190 and anti-rotation rail 180 may be used in combination with either substantially P-shaped carriage track 60, substantially T-shaped carriage track 60', or otherwise configured carriage tracks falling within the scope of the present invention. Likewise, hangers 70, 70', anti-rotation rails 80, 80', and/or bridges 90, 90' may be used in combination with inverted, substantially V-shaped carriage track 160 or otherwise configured carriage tracks falling within the scope of the present invention.

Figure 7:
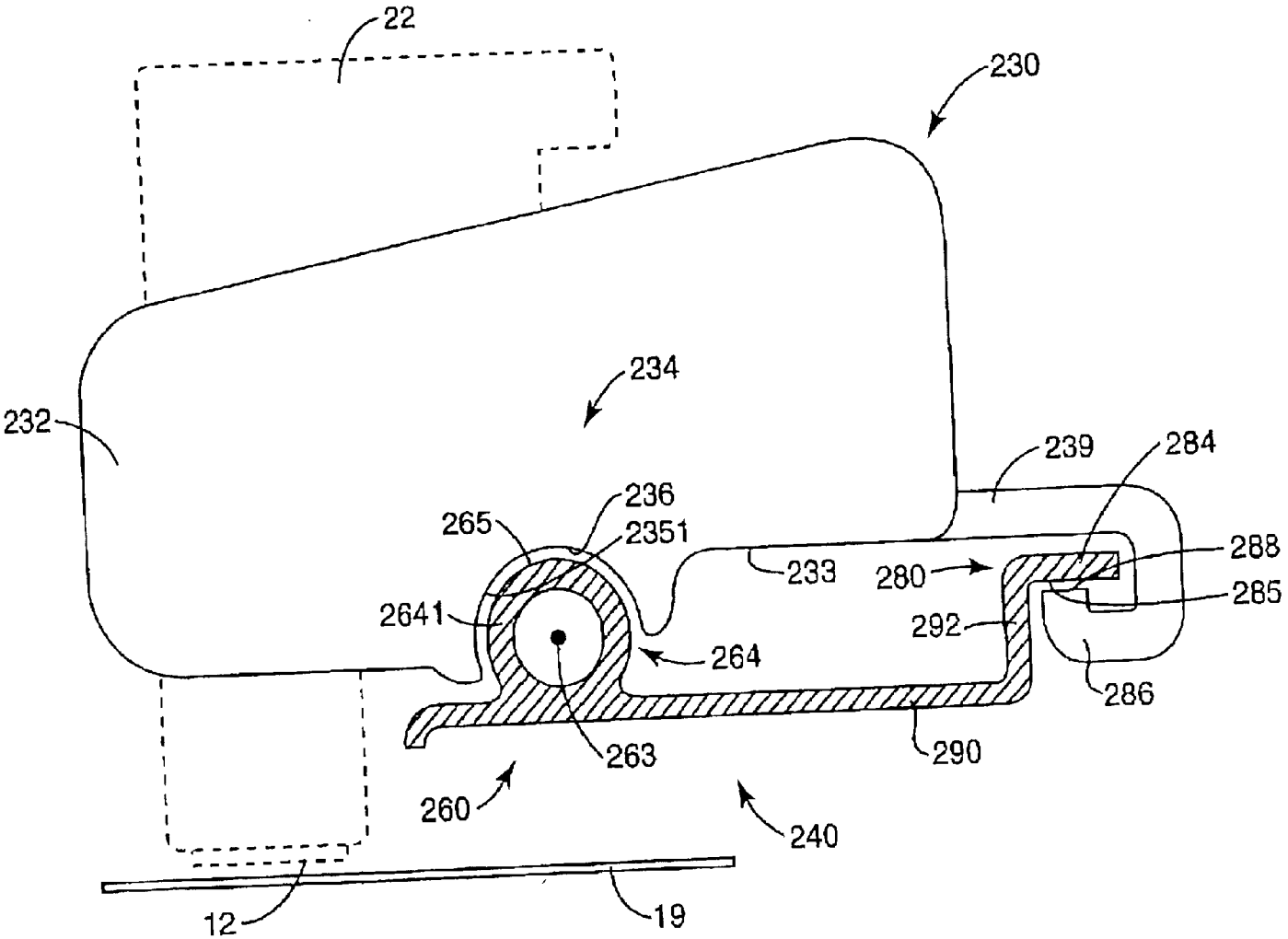
FIG. 7 is a schematic, cross-sectional view of a portion of another embodiment of a carriage guide and a carriage according to the present invention.

FIG. 7 illustrates another embodiment of carriage guide 40. Carriage guide 240 includes a carriage track 260 for supporting a carriage 230. Carriage track 260 has a substantially O-shaped cross-section. As such, carriage track 260 has an axis 263 and includes a carriage track segment 2641 which extends substantially parallel with and is centered about axis 263.

In one embodiment, carriage track segment 2641 forms carriage track 260 with the substantially O-shaped cross-section. Carriage track segment 2641 is curved to form a substantially continuous circle about axis 263. As such, carriage track segment 2641 forms a surface that substantially encompasses axis 263. In addition, carriage track segment 2641 forms a support surface 265 to contact and support carriage 230.

Carriage 230 includes a carriage shell 232 and a carriage base 233. Carriage 230 carries print cartridge 22, including inkjet printhead assembly 12, and is slidably mounted upon carriage track 260. As such, carriage 230 includes a receptor groove 234 sized and shaped to interact with carriage track 260. Receptor groove 234 corresponds with the substantially O-shaped cross-section of carriage track 260 and includes a sidewall 2351. Sidewall 2351 is curved to be received by carriage track 260.

In one embodiment, sidewall 2351 of receptor groove 234 forms a contact surface 236 that interacts with support surface 265 of carriage track 260. More specifically, contact surface 236 interacts with support surface 265 to guide carriage 230 on carriage track 260 and to retain carriage 230 on carriage track 260 so as to prevent lift-off of carriage 230. The interaction between support surface 265 and contact surface 236 allows carriage 230 to traverse carriage track 260. Contact surface 236 and/or support surface 265 may be lubricated, wear protected, and/or kept clear of dust and debris to ensure a smooth interaction between carriage 230 and carriage track 260. In addition, contact surface 236 may include one or more protrusions which protrude from sidewall 2351 in a manner similar to that described above with reference to contact surfaces 136, 137, and 138 of receptor groove 134.

FIG. 7 illustrates another embodiment of anti-rotation rail 80. Anti-rotation rail 280 is spaced from carriage track 260 and extends between first chassis sidewall 52 and second chassis sidewall 54. Anti-rotation rail 280 includes a stabilization segment 284 having a support surface 285 that interacts with carriage 230 to stabilize carriage 230 and prevent rotation of carriage 230 about carriage track 260.

In one embodiment, carriage 230 includes a wear device 286 including a contact or anti-rotation surface 288 that contacts support surface 285 of anti-rotation rail 280 and maintains proper interaction between anti-rotation rail 280 and carriage 230. Wear device 286 is provided, for example, on a carriage arm 239 extending from carriage shell 232 along carriage base 233 Anti-rotation surface 288 and/or support surface 285 may be lubricated, wear protected, and/or kept clear of dust and debris to ensure smooth interaction and movement of carriage 230 across carriage track 260. In addition, anti-rotation surface 288 may include one or more protrusions which protrude from wear device 286 in a manner similar to that described above with reference to anti-rotation surface 188 of wear device 186.

In one embodiment, a bridge 290 extends between carriage track 260 and anti-rotation rail 280. More specifically, bridge 290 extends between an edge of carriage track segment 2641 of carriage track 260 to anti-rotation rail 280. In one embodiment, bridge 290 includes a vertical portion 292 to accommodate vertical displacement of anti-rotation rail 280. Preferably, carriage track 260, bridge 290, and anti-rotation rail 280 are integrally formed as one unitary structure to form a monolithic stay. Although carriage track 260, bridge 290, and anti-rotation rail 280 are illustrated as a monolithic stay, carriage track 260, bridge 290, and anti-rotation rail 280 may be formed separately and joined together to form a unified structure.

While bridge 290 and anti-rotation rail 280 are illustrated with substantially O-shaped carriage track 260, it is understood that bridge 290 and anti-rotation rail 280 may be used in combination with either substantially P-shaped carriage track 60, substantially T-shaped carriage track 60', inverted, substantially V-shaped carriage track 160, or otherwise configured carriage tracks falling within the scope of the present invention. Likewise, hangers 70, 70', 170, anti-rotation rails 80, 80', 180, and/or bridges 90, 90', 190 may be used in combination with substantially O-shaped carriage track 260 or otherwise configured carriage tracks falling within the scope of the present invention While carriage tracks 60, 60', 160, and 260 are illustrated as having a substantially P-shaped cross-section, a substantially T-shaped cross-section, an inverted, substantially V-shaped cross-section, and an O-shaped cross-section, respectively, it is understood that other carriage track configurations, produced by other associations of segments or sections designed to support and stabilize carriage 30 are within the scope of the present invention. As such, carriage receptor groove 34 is designed accordingly to receive an associated carriage track configuration.

Carriage guides 40, 40', 140, and 240 are each designed to not only support carriages 30, 30', 130, and 230, respectively, but to also stabilize carriages 30, 30', 130, and 230, respectively, in order to maintain consistent spacing between printhead 12 and print medium 19. Furthermore, carriage guides 40, 40', 140, and 240 ensure smooth movement of carriages 30, 30', 130, and 230, respectively, without utilizing precision ground steel rods and, as a result, reduce the production cost of inkjet printers.

By forming carriage track 60, bridge 90, and hanger 70 as one unitary structure, with anti-rotation rail 80 either being formed separately from or integrally with hanger 70, carriage track 60, bridge 90, hanger 70, and anti-rotation rail 80 form carriage guide 40 which can be installed in one step. As such, carriage guide 40 provides multiple support surfaces which cooperate to guide and retain carriage 30 for movement between first chassis sidewall 52 and second chassis sidewall 54.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A carriage guide for a carriage of an inkjet printer, the carriage guide comprising:

a chassis including a first chassis sidewall and a second chassis sidewall spaced from the first chassis sidewall; and a carriage track extending between the first chassis sidewall and the second chassis sidewall, wherein the carriage track forms at least two support surfaces configured to support the carriage for movement along the carriage track.

2. The carriage guide of claim 1, wherein one of the at least two support surfaces of the carriage track is configured to guide the carriage on the carriage track and one of the at least two support surfaces of the carriage track is configured to retain the carriage on the carriage track.

3. The carriage guide of claim 1, wherein the carriage track forms at least three support surfaces configured to support the carriage for movement along the carriage track, wherein two of the at least three support surfaces are configured to guide the carriage on the carriage track and one of the at least three support surfaces is configured to retain the carriage on the carriage track.

4. The carriage guide of claim 1, wherein the carriage track has an axis extending between the first chassis sidewall and the second chassis sidewall, and wherein the at least two support surfaces of the carriage track extend substantially parallel with and are configured to support the carriage for movement along the axis.

5. The carriage guide of claim 4, wherein the carriage track includes a plurality of segments each extending substantially parallel with the axis, wherein the plurality of segments are arranged to form a cross-sectional shape configured to support the carriage.

6. The carriage guide of claim 5, wherein a junction of two of the plurality of segments of the carriage track forms one of the at least two support surfaces.

7. The carriage guide of claim 5, wherein each of the plurality of segments of the carriage track form a substantially planar surface oriented substantially parallel with the axis.

8. The carriage guide of claim 7, wherein the substantially planar surface of at least one of the plurality of segments forms one of the at least two support surfaces.

9. The carriage guide of claim 5, wherein the plurality of segments of the carriage track are arranged to form a substantially P-shaped cross-section and include:

a first segment having a substantially vertical orientation, a second segment extending from and oriented substantially perpendicular to the first segment, a third segment extending from and oriented substantially perpendicular to the second segment, a fourth segment extending from the third segment toward the first segment and oriented substantially perpendicular to the third segment, and a fifth segment extending from and oriented substantially perpendicular to the fourth segment.

10. The carriage guide of claim 9, wherein a junction of the first segment and the second segment forms a first support surface, a junction of the second segment and the third segment forms a second support surface, and the fourth segment forms a third support surface.

11. The carriage guide of claim 5, wherein the plurality of segments of the carriage track are arranged to form a substantially T-shaped cross-section and include:

a first segment having a substantially vertical orientation, a second segment extending from and oriented substantially perpendicular to the first segment, a third segment extending from and oriented substantially perpendicular to the second segment, a fourth segment extending from and oriented substantially perpendicular to the third segment, a fifth segment extending from and oriented substantially perpendicular to the fourth segment, a sixth segment extending from the fifth segment toward the first segment and oriented substantially perpendicular to the fifth segment, and a seventh segment extending from and oriented substantially perpendicular to the sixth segment.

12. The carriage guide of claim 11, wherein the second segment forms a first support surface, a junction of the third segment and the fourth segment forms a second support surface, a junction of the fourth segment and the fifth segment forms a third support surface, and the sixth segment forms a fourth support surface.

13. The carriage guide of claim 5, wherein the plurality of segments of the carriage track are arranged to form an inverted, substantially V-shaped cross-section and include:

a first segment having an angled orientation, and a second segment extending from and oriented at an angle to the first segment.

14. The carriage guide of guide 13, wherein a first side of the first segment forms a first support surface and a second side of the first segment forms a second support surface, and wherein the second segment forms a third support surface.

15. A carriage for holding a print cartridge on a carriage track of an inkjet printer, the carriage comprising:

a carriage shell adapted to receive the print cartridge; and a carriage base supporting the carriage shell and including a receptor groove configured to receive the carriage track, wherein the receptor groove has at least two contact surfaces configured to contact at least two support surfaces of the carriage track.

16. The carriage or claim 15, wherein one of the at least two contact surfaces of the receptor groove is configured to guide the carriage on the carriage track and one of the at least two contact surfaces of the receptor groove is configured to retain the carriage on the carriage track.

17. The carriage of claim 15, wherein the receptor groove has at least three contact surfaces configured to contact at least three support surfaces of the carriage track, wherein two of the at least three contact surfaces are configured to guide the carriage on the carriage track and one of the at least three contact surfaces is configured to retain the carriage on the carriage track.

18. The carriage of claim 15, wherein the receptor groove includes a plurality of sidewalls configured to receive the carriage track, wherein the sidewalls form the at least two contact surfaces.

19. The carriage of claim 18, wherein each of the plurality of sidewalls of the receptor groove form a substantially planar surface.

20. The carriage of claim 19, wherein the substantially planar surface of at least one of the plurality of sidewalls forms one of the at least two contact surfaces.

21. The carriage of claim 18, wherein the plurality of sidewalls of the receptor groove are configured to receive a substantially P-shaped cross-section of the carriage track and include:

a first sidewall having a substantially vertical orientation, a second sidewall contiguous with and oriented at an angle to the first sidewall, a third sidewall contiguous with the second sidewall and oriented substantially perpendicular to the first sidewall, a fourth sidewall contiguous with and oriented at an angle to the third sidewall, a fifth sidewall contiguous with the fourth sidewall and oriented substantially parallel with the first sidewall, a sixth sidewall contiguous with and oriented substantially perpendicular to the fifth sidewall, and a seventh sidewall contiguous with and oriented substantially perpendicular to the sixth sidewall.

22. The carriage of claim 21, wherein the second sidewall forms a first contact surface, the fourth sidewall forms a second contact surface, and the sixth sidewall forms a third contact surface.

23. The carriage of claim 18, wherein the plurality of sidewalls of the receptor groove are configured to receive a substantially T-shaped cross-section of the carriage track and include:

a first sidewall having a substantially vertical orientation, a second sidewall contiguous with and oriented substantially perpendicular to the first sidewall, a third sidewall contiguous with and oriented substantially perpendicular to the second sidewall, a fourth sidewall contiguous with and oriented at an angle to the third sidewall, a fifth sidewall contiguous with the fourth sidewall and oriented substantially perpendicular to the first sidewall, a sixth sidewall contiguous with and oriented at an angle to the fifth sidewall, a seventh sidewall contiguous with the sixth sidewall and oriented substantially parallel with the first sidewall, an eighth sidewall contiguous with and oriented substantially perpendicular to the seventh sidewall, and a ninth sidewall contiguous with and oriented substantially perpendicular to the eighth sidewall.

24. The carriage of claim 23, wherein the second sidewall forms a first contact surface, the fourth sidewall forms a second contact surface, the sixth sidewall forms a third contact surface, and the eighth sidewall forms a fourth contact surface.

25. The carriage of claim 18, wherein the plurality of sidewalls of the receptor groove are configured to receive an inverted, substantially V-shaped cross-section of the carriage track and include:

a first sidewall having an angled orientation, a second sidewall contiguous with and oriented substantially perpendicular to the first sidewall, a third sidewall contiguous with and oriented substantially perpendicular to the second sidewall, and a fourth sidewall contiguous with and oriented at an angle to the third sidewall.

26. The carriage of claim 25, wherein the first sidewall forms a first contact surface, the third sidewall forms a second contact surface, and the fourth sidewall forms a third contact surface.

27. An inkjet printer, comprising:

a carriage track including at least two support surfaces; and a carriage including a receptor groove configured to receive the carriage track and having at least two contact surfaces, wherein the at least two contact surfaces of the receptor groove contact the at least two support surfaces of the carriage track and support the carriage for movement along the carriage track.

28. The inkjet printer of claim 27, wherein the carriage track has an axis, and wherein the at least two support surfaces of the carriage track extend substantially parallel with and are configured to support the carriage for movement along the axis.

29. The inkjet printer of claim 27, wherein one of the at least two contact surfaces of the receptor groove contacts one of the at least two support surfaces of the carriage track to guide the carriage on the carriage track and one of the at least two contact surfaces of the receptor groove contacts one of the at least two support surfaces of the carriage track to retain the carriage on the carriage track.

30. The inkjet printer of claim 27, wherein the carriage track forms at least three support surfaces and the receptor groove has at least three contact surfaces, wherein the at least three contact surfaces of the receptor groove contact the at least three support surfaces of the carriage track and support the carriage for movement along the carriage track.

31. The inkjet printer of claim 30, wherein two of the at least three contact surfaces of the receptor groove contact two of the at least three support surfaces of the carriage track to guide the carriage on the carriage track and one of the at least three contact surfaces of the receptor groove contacts one of the at least three support surfaces of the carriage track to retain the carriage on the carriage track.

32. A method of supporting a carriage of an inkjet printer, the method comprising:

spacing a first chassis sidewall from a second chassis sidewall;

extending a carriage track between the first chassis sidewall and the second chassis sidewall; and receiving the carriage track in a receptor groove of the carriage, including contacting at least two support surfaces of the carriage track with at least two contact surfaces of the receptor groove.

33. The method of claim 32, wherein contacting at least two support surfaces of the carriage track with at least two contact surfaces of the receptor groove includes guiding the carriage on the carriage track with one of the at least two contact surfaces of the receptor groove and one of the at least two support surfaces of the carriage track.

34. The method of claim 32, wherein contacting at least two support surfaces of the carriage track with at least two contact surfaces of the receptor groove includes retaining the carriage on the carriage track with one of the at least two contact surfaces of the receptor groove and one of the at least two support surfaces of the carriage track.

* * * * *